United States Patent [19]

Jones

[11] Patent Number: 4,718,595

[45] Date of Patent: Jan. 12, 1988

[54] PAPERBOARD CONTAINER FOR FAST FOOD

[76] Inventor: Kenneth W. Jones, 615 Quail Run, Middletown, Ohio 45042

[21] Appl. No.: 892,839

[22] Filed: Aug. 4, 1986

[51] Int. Cl.[4] ..... B65D 5/18

[52] U.S. Cl. ..... 229/1.5 B; 229/16 A; 229/DIG. 9; 229/902

[58] Field of Search ..... 229/1.5 B, 8, 16 A, 229/DIG. 9, 902; 294/55

[56] References Cited

U.S. PATENT DOCUMENTS 2,323,287 7/1943 Amberg ..... 229/1.5 B
3,743,169 7/1973 Person ..... 229/16 A
4,124,160 11/1978 Meyers et al. ..... 229/1.5 B
4,502,623 3/1985 Moore, Jr. et al. ..... 229/1.5 B

FOREIGN PATENT DOCUMENTS 1313038 11/1962 France ..... 229/16 A

*Primary Examiner*—Stephen Marcus
*Assistant Examiner*—Gary E. Elkins
*Attorney, Agent, or Firm*—Wood, Herron & Evans

[57] ABSTRACT

A scoop for French fries or the like having a back wall, a front wall and a bottom wall. Side flaps hinged to the front wall and back wall, respectively, include glue flaps at their upper end portions and recesses at the lower end portions. Openings created by the recesses are covered by bottom flaps that interlock with the edges of the recesses to stabilize the containers.

4 Claims, 11 Drawing Figures

PAPERBOARD CONTAINER FOR FAST FOOD

This invention relates to a paperboard container and more particularly to a container forming a scoop for French fries and the like to be used in connection with the dispensing of food in a fast food restaurant.

BACKGROUND OF THE INVENTION

The scoop to which the present invention relates consists of a back wall, a bottom wall hinged to the back wall and a front wall hinged to the bottom wall. The side edges of the back and front wall have glue flaps hinged to them, these flaps being glued together to form an open-ended scoop.

The scoops have been manufactured on in-line machines as well as on more conventional scoop-forming machines. An in-line machine has multiple processing stations which process a web of paperboard in a sequence of operations. The machine includes a printing station; a cutting and scoring station; a stripper; and a forming station. One such forming station can be of the type disclosed in my copending application Ser. No. 740,638, filed June 3, 1985. As a web is fed through those stations, it is first printed. Then the web is cut and scored in such a way as to define the individual containers, the containers still remaining in web form. At the stripping station, the individual container blanks are stripped away from the web. The blanks are fed into the forming station where each container is formed around a mandrel with glue applied to the side flaps. The thus formed container is stripped off the mandrel and pushed into a stack in nesting relationship to previously-formed containers. While in that stack, the container is held in its formed condition while the glue on the side flaps sets.

The in-line machines process multiple containers simultaneously from a single web. For example, the machines might process five containers transversely across the web. Forming containers in that fashion would be referred to as "five up."

Two commercially known scoops are shown in FIGS. 1,2 and 3,4, respectively, of the drawings. As shown in FIG. 1, the scoop includes a back wall 10, a front wall 11, and a bottom wall 12. Side flaps 13 are hinged to the back wall and side flaps 14 are hinged to the front wall. The flaps 14 have lower edges 15 which abut the back wall 10, thereby tending to fix the distance between the front and back walls and hence the volume of the containers. That container is disclosed in U.S. Pat. No. 4,502,623.

To form the container, the flat blanks therefor are laid out on a web as shown in FIG. 2. The web, of course, is initially a plain, unprinted, uncut, unscored paperboard web. The illustration of FIG. 2 is to show how the individual scoops will be cut from the web, the hatched areas representing scrap to be discarded. As can be seen, the individual scoops are aligned side-by-side or transversely as well as being aligned longitudinally. For the purposes of illustrating the invention, it will be assumed that the distance between center lines of adjacent containers is 1.0X inches.

The second form of prior art to be discussed is illustrated in FIGS. 3 and 4. There, the back wall, front wall and bottom wall are the same as in the previous patented embodiment. In the embodiment of FIGS. 3 and 4, however, the side walls 23 and 24 are narrower than in the previous embodiment. It can be seen that the edges of the side flaps 24 do not abut the back wall 10.

This construction has an advantage as well as a disadvantage. The advantage is that the containers can be manufactured in a nesting relationship as shown in FIG. 4, the hatched areas again representing scrap. It will be observed that the containers in one longitudinal file are in staggered relation with the scoops in the adjoining longitudinal file, thus permitting the containers to nest on the web. The distance between centers is reduced to 0.87X inches, thereby presenting a 13% saving in board over the patented embodiment. There is a sacrifice, however. Because the side flaps are narrow enough to permit the nesting relationship, they do not provide the stability required to produce uniform volume containers at all times. Even the patented container admits of a certain amount of skewing of back wall with respect to front wall, but it is not as pronounced as in the container of FIGS. 3 and 4.

BRIEF SUMMARY OF THE INVENTION

It has been an objective of the invention to provide a container which requires less board per container as compared to prior art practices.

It is another object of the invention to provide a container which is more stable than either of the prior art containers.

These objectives of the invention are attained by providing a container having a front wall, back wall and bottom wall substantially identical to those of the prior art containers. In the side flaps, however, the significant changes have been made. Specifically, each side wall has been recessed adjacent the bottom wall and a glue tab has been positioned to project from the top or upper end of each side flap. The combined recessing and projecting tab permits a nesting relationship reducing the distance between centers of adjacent containers to about 0.75X, that being about a 25% reduction over the first prior art container described above.

The recesses in the bottom portion of the side flaps creates a hole or opening. The invention provides bottom flaps projecting laterally outward from the bottom wall. The bottom flaps are snapped into the opening created by the recesses, thereby closing up those recesses. The bottom flaps, however, provide another very important function, namely, to stabilize the container. When the bottom flaps are snapped into position, the upper portion of each bottom flap is engaged by the upper edges of the side flaps which define the recesses, thereby blocking movement of the front wall toward the back wall. Thus, the bottom flaps provide a rigidity of stability to the container which provides assurance that every container will have the same volume as every other container and that the containers will not become skewed as they are being formed and immediately after their formation.

The several objectives and features of the invention will become more readily apparent from the following detailed description taken in conjunction with the accompanying drawings in which.

Figure 5:
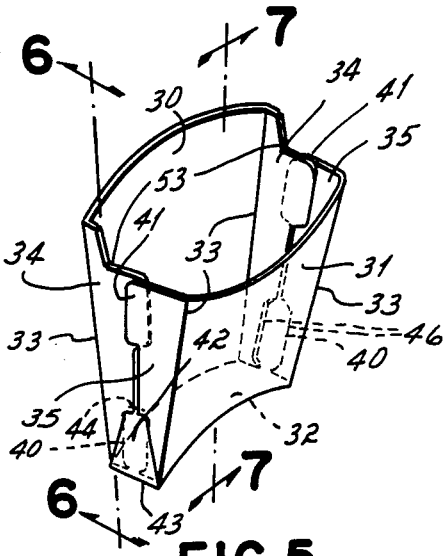
FIG. 5 is a perspective view of a scoop embodying the present invention.

The scoop or container of FIG. 5 has a back wall 30, a front wall 31, these walls being hinged to a bottom wall 32. The walls 30 and 31 have side edges 33. Side flaps 34 are hinged to the side edges of the back wall 30 and side flaps 35 are hinged to the side edges of the front wall 31. Each side flap has a recess 40 adjacent the bottom wall 32 and a glue tab 41 adjacent its upper edge. The glue tabs are adhesively secured together to hold the scoop in the erected condition illustrated in FIG. 5.

Figure 6:
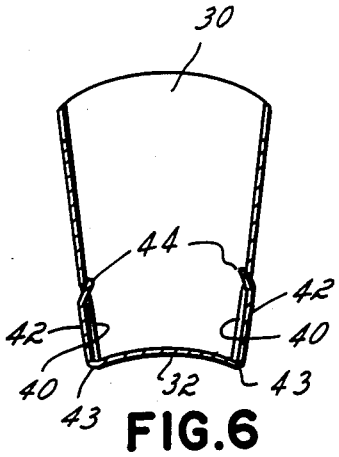
FIG. 6 is a cross-sectional view taken along lines 6—6 of FIG. 5.
Figure 7:
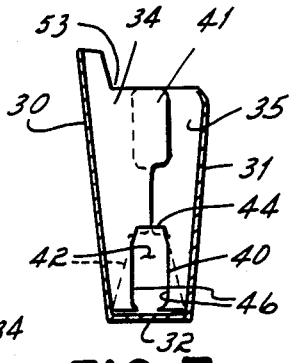
FIG. 7 is a cross-sectional view taken along lines 7—7 of FIG. 5.

The scoop has bottom flaps 42 hinged along lines 43 to the bottom wall 32. The bottom flaps 42 are folded up and their upper end portions 44 are folded into the container as illustrated in FIG. 6 (the bend being slightly exaggerated). The bottom flaps 42 thus cover the openings created by the recesses 40 when the scoop is in its erect condition. The recesses 40 are defined by facing edges 46. The upper portions of those edges engage the inwardly-projecting portions 44 of the bottom flaps 42, thereby fixing the relative position of the back wall 30 with respect to the front wall 31. That interlocking of edges imparts to the container a rigidity and stability that has not been obtainable in any of the prior art containers. The interlocking relationship provides assurance that while the containers are nested within one another immediately following their formation, and while the glue on the glue tabs 41 is setting, there will be no skewing of the front wall with respect to the back wall resulting in an unsightly container and resulting in variations in the volume of the containers with respect to each other.

Figure 8:
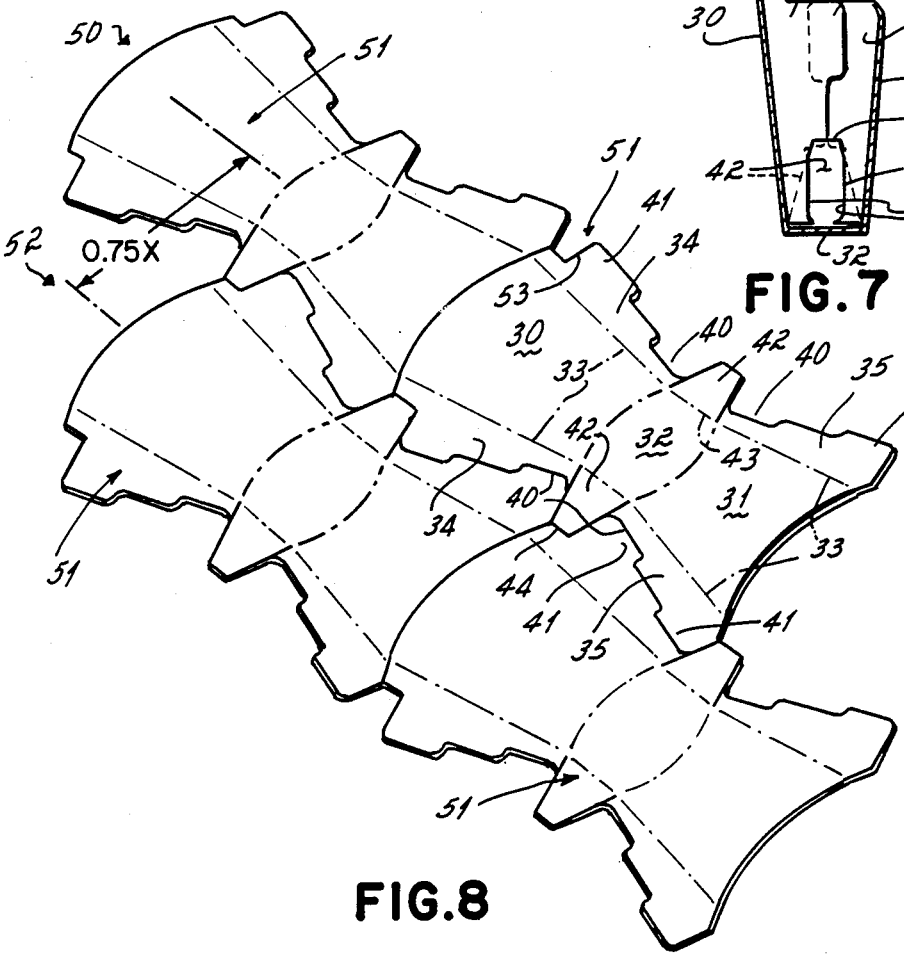
FIG. 8 is a plan view of a layout of blanks to form the scoop of FIG. 7.

By referring to FIG. 8, it can be seen that in the manufacture of the containers from a paperboard web, the flat blanks can be laid out in a nesting relationship to provide a significant saving in the material or board by which the containers are made. FIG. 8 shows a first row of blanks 51 and a second row 52 of blanks 51. The second row 52 is staggered with relation to the first row 50. Additional rows may be laid out alongside rows 50 and 52 with the adjoining rows being in staggered relationship to each other. From the plan view of FIG. 8, it can be seen that the recesses 40 create the glue tabs 41 of the adjoining containers. Further, the bottom flaps 42 define the configuration of the top edge 53 of the container. A variety of top edge configurations are thus available as long as the resulting configuration of the bottom flaps 42 provides the necessary interlock for positioning the front and back walls of the container.

As can be seen from FIG. 8, it is possible to configurate the blanks in such a way as to eliminate entirely the internal scrap of the type shown in the drawings of the prior art.

Figure 1:
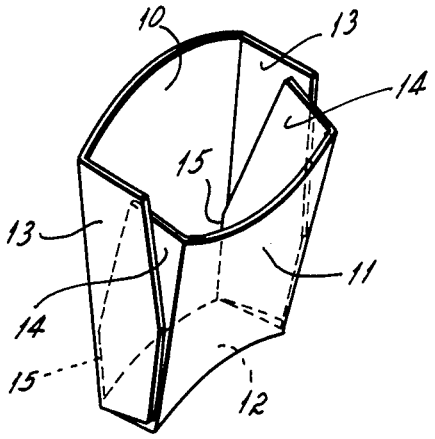
PRIOR ART FIG. 1
FIG. 1 is a perspective view of a prior art scoop.
Figure 2:
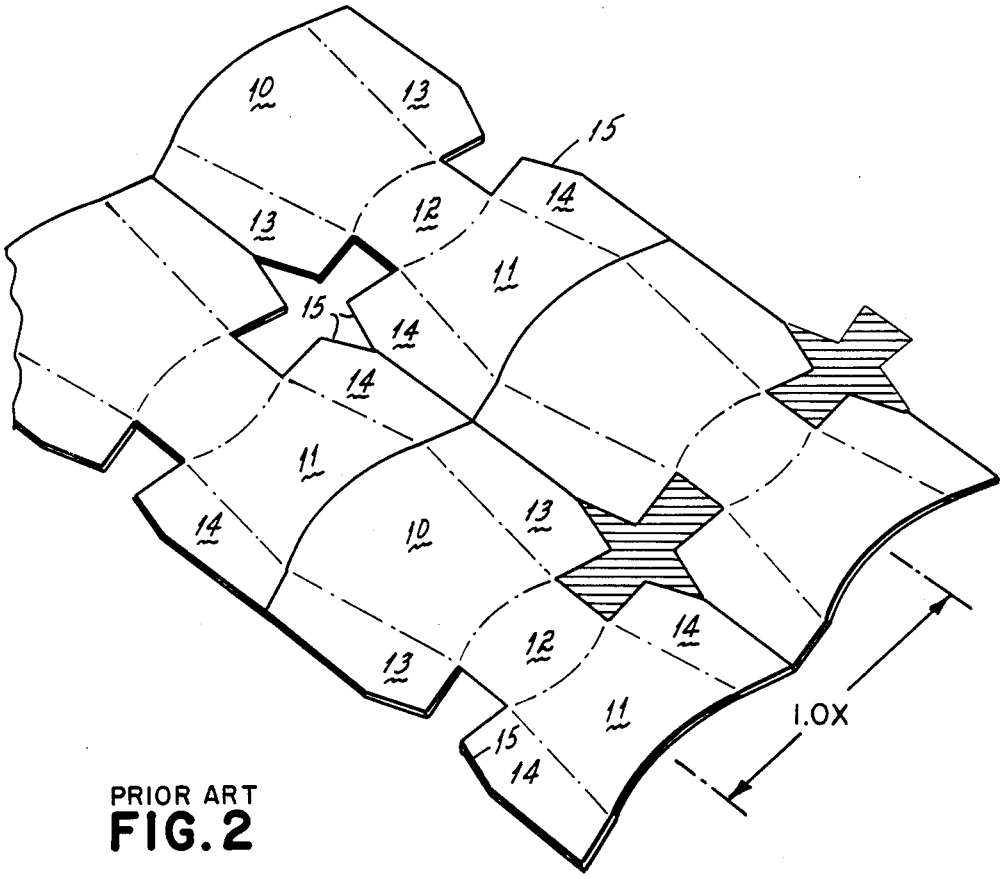
PRIOR ART FIG. 2
FIG. 2 is a plan view of the blanks for making the scoop of FIG. 1.
Figure 3:
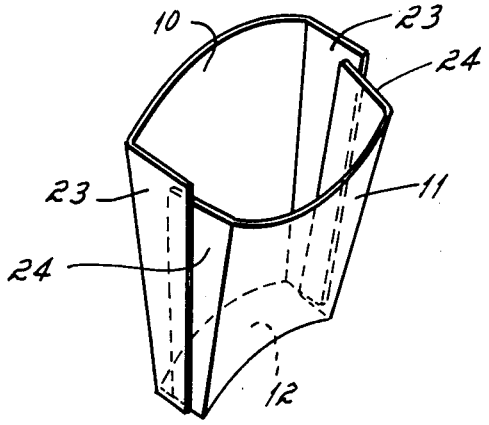
PRIOR ART FIG. 3
FIG. 3 is a perspective view of an alternative form of prior art scoop.
Figure 4:
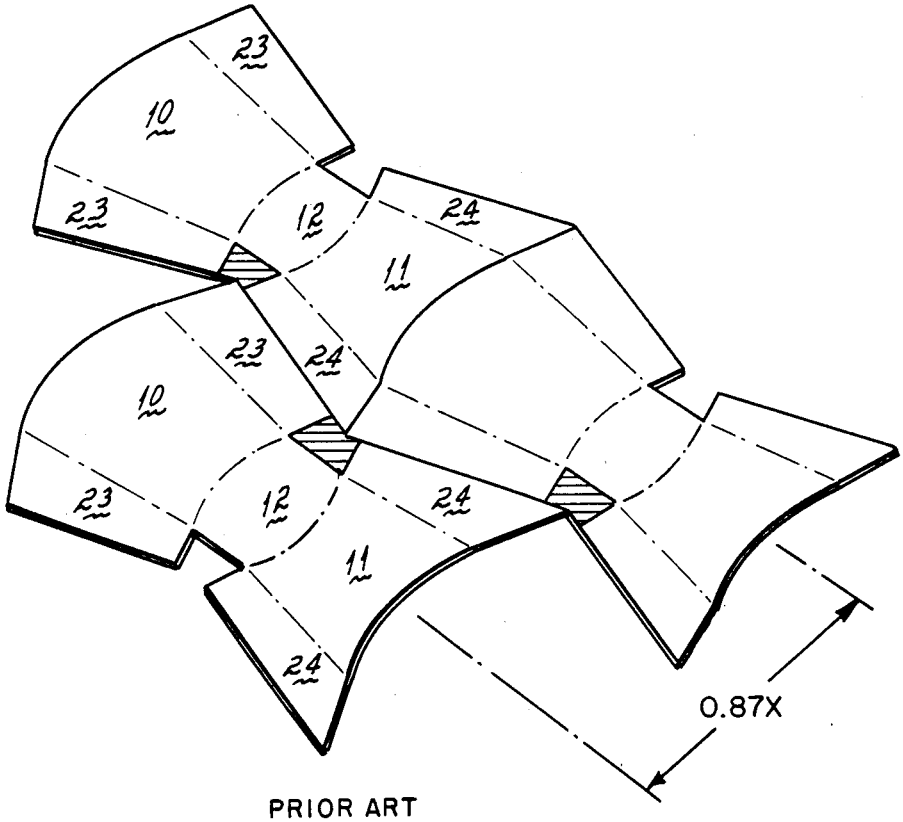
PRIOR ART FIG. 4
FIG. 4 is a plan view of the layout of blanks for forming the scoop of FIG. 3.

It can be seen by reference to FIG. 8 that the board required, as compared to the prior art embodiment of FIGS. 1 and 2, is about 0.75X, thus resulting in a savings of about 25%.

Figure 9:
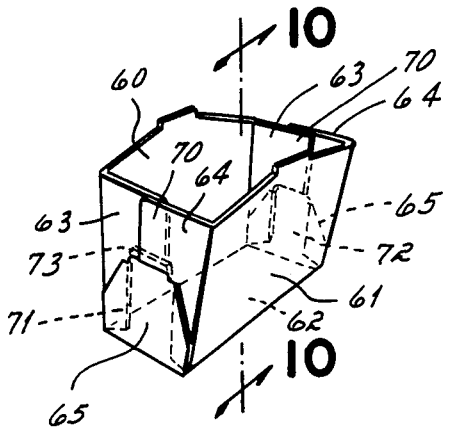
FIG. 9 is a perspective view of an alternative form of scoop which may be used for hamburgers.
Figure 10:
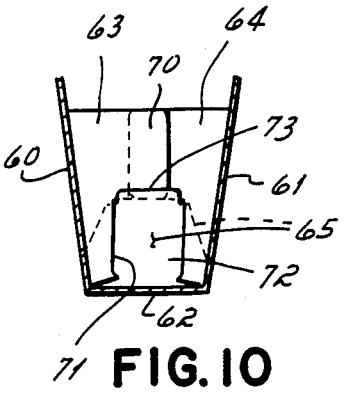
FIG. 10 is a cross-sectional view taken along lines 10—10 of FIG. 9.
Figure 11:
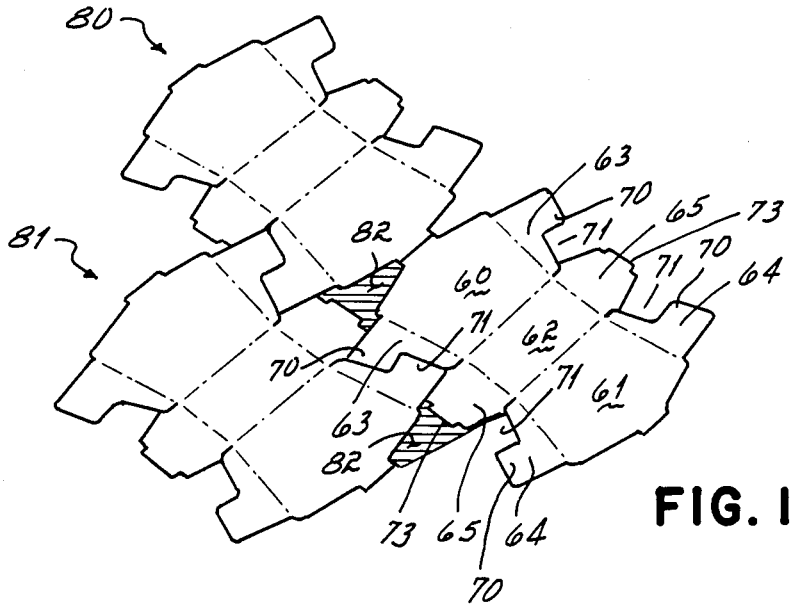
FIG. 11 is a plan view of a layout of flat blanks to form the scoop of FIG. 9.

An alternative configuration for the container is shown in FIGS. 9–11. This configuration of scoop is ideally suited for carryout hamburgers. The scoop has a back wall 60 and front wall 61. The back wall and front wall are hinged to a bottom wall 62. Side flaps 63 are hinged to the back wall 60 and side flaps 64 are hinged to the front wall 61. Bottom flaps 65 are hinged to the bottom wall 62. Each side flap has at its upper edge a glue tab 70 and at its lower edge adjacent the bottom wall a recess 71. The glue tabs 70 overlap one another at the side edges and are glued together to form side walls. The recesses 71 face each other and create between them an opening 72. The bottom flap 65 is folded up to close the opening 72. The bottom flap has an upper edge portion 73 which projects into the container and interlocks with the edges of the side flaps that define the recesses 71. Thus, the upper edge portion of each bottom flap forms an interlock with the side flaps to correctly space the front and back walls from each other and to provide a uniform volume container.

FIG. 11 shows the manner in which the containers are laid out on a flat web in nesting relation to provide economy of manufacture. A first row of container blanks indicated at 80 is laid out adjacent a second row of blanks 81, the second row being in staggered relation to the first row. Again, multiple rows, with adjoining containers being in staggered relation to each other, will be laid out across a web. To provide the nesting relationship, the recesses 71 create the glue tabs 70 of the adjoining containers. In this embodiment, the bottom flaps 65 do not contribute to the upper edge configuration of the front and back walls. Rather, a separate removable piece 82 is used to configurate the upper edge of the container.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof.

I claim:

1. A paperboard container comprising, a front wall, bottom wall hinged to said front wall and a back wall hinged to said bottom wall, each of said front and back walls having side edges on opposite sides of said walls, a side flap hinged to each side edge, each side flap having a recess at one end adjacent said bottom wall and a glue tab at the other end of said side flap, the glue tabs on said facing side flaps of said back and front walls overlapping and being glued together to form a scoop type container, the recesses on facing side walls forming openings at the bottom of said container when said tabs are glued together, and bottom flaps hinged to the end edges of said bottom wall, said bottom flaps being tucked into said openings to close them.

2. In a web for forming container blanks to make the containers of claim 1, a plurality of containers as in claim 5 laid out in a flat staggered side-by-side and end-to-end orientation, the glue tabs of one container being disposed in the recesses of the adjoining container, the glue tabs of end-to-end containers creating second recesses, said bottom flaps being disposed in said second recesses, whereby to minimize the board required to make said containers.

3. In a paperboard container having a front wall having top and side edges, a bottom wall hinged to the front wall, a back wall having a top and side edges hinged to the bottom wall, side flaps hinged to the side edges of said front and back walls, the improvement comprising:

said side flaps each having a recess adjacent said bottom wall, said side flaps each having glue tabs adjacent said top edges of said front and back walls, respectively, said glue tabs that are adjacent to each other being glued together to form said container having side walls formed by said side flaps, bottom flaps hinged to opposite sides of said bottom wall, said side walls each having an opening formed by said facing recesses, said bottom flaps folded over said openings in said side walls and tucked behind said side flaps.

4. A container as in claim 3 in which said side walls have edges which define said recesses, each bottom flap having side edges, said bottom flap side edges and said recess edges being in engagement when said bottom flap is tucked behind said side flap, thereby stabilizing said container while the glue sets and thereafter.

* * * * *